US009380916B2

(12) United States Patent
Allef et al.

(10) Patent No.: US 9,380,916 B2
(45) Date of Patent: Jul. 5, 2016

(54) DISPENSER SYSTEM

(75) Inventors: Petra Allef, Krefeld (DE); Annette Zur Mühlen, Krefeld (DE); Bernd Nauels, Kempen (DE); Markus Pielen, Schwalmtal (DE)

(73) Assignee: Evonik Stockhausen GmbH, Krefeld (DE)

( * ) Notice: Subject to any disclaimer, the term of this patent is extended or adjusted under 35 U.S.C. 154(b) by 164 days.

(21) Appl. No.: 13/054,564

(22) PCT Filed: Apr. 30, 2009

(86) PCT No.: PCT/EP2009/055278

§ 371 (c)(1),
(2), (4) Date: Jan. 17, 2011

(87) PCT Pub. No.: WO2010/009910

PCT Pub. Date: Jan. 28, 2010

(65) Prior Publication Data

US 2011/0121038 A1 May 26, 2011

(30) Foreign Application Priority Data

Jul. 22, 2008 (DE) ..... 10 2008 002 957

(51) Int. Cl.
*B67D 7/58* (2010.01)
*A47K 5/14* (2006.01)
*A47K 5/12* (2006.01)

(52) U.S. Cl.
CPC ..... *A47K 5/14* (2013.01); *A47K 5/1204* (2013.01)

(58) Field of Classification Search
CPC ..... A47K 5/14; A47K 5/1204
USPC ..... 222/144.5, 180, 181.1, 182, 207, 214, 222/321.6, 321.9, 325, 181.2, 181.3, 185.1
See application file for complete search history.

(56) References Cited

U.S. PATENT DOCUMENTS

D124,199 S * 12/1940 Petzold ..... D6/545
3,613,958 A * 10/1971 Opp ..... 222/180

(Continued)

FOREIGN PATENT DOCUMENTS

DE 29702014 U1 5/1997
EP 1090577 4/2001

(Continued)

OTHER PUBLICATIONS

PCT International Preliminary Search Report on Patentability & Written Opinion; PCT/EP2009/055278; Authorized Officer: Agnes Wittmann-Regis; May 3, 2011.

*Primary Examiner* — Nicholas J Weiss
(74) *Attorney, Agent, or Firm* — Stetina Brunda Garred & Brucker

(57) ABSTRACT

The invention relates to a dispenser system with a housing, into which a reservoir cartridge is inserted, which is formed by a reservoir container and a distribution device. Housing comprises an actuation device which acts on distribution device in such a way that a pressure on the actuation device delivers a portion of the medium on the distribution device. The known dispenser systems have the drawback that an individual dispenser is required depending on the medium. According to the invention, in order to create an identical part dispenser system, a connection element compensating for the different geometries of distribution device is connected to distribution device. Moreover, actuation device comprises at different levels pressure-exerting faces, which cooperate with pressure-receiving faces of distribution device, wherein different faces engage with one another depending on employed reservoir cartridge.

13 Claims, 16 Drawing Sheets

(56) References Cited

U.S. PATENT DOCUMENTS

| | | | | | |
|---|---|---|---|---|---|
| 4,164,306 | A | * | 8/1979 | Perrin | 222/181.2 |
| 4,214,676 | A | * | 7/1980 | Cassia | 222/83.5 |
| D269,948 | S | * | 8/1983 | Janssen | D9/523 |
| 4,911,331 | A | * | 3/1990 | Sedam | 222/132 |
| 5,238,160 | A | * | 8/1993 | Faulds | 224/414 |
| 5,242,081 | A | * | 9/1993 | van der Heyden et al. | 222/1 |
| 5,265,772 | A | * | 11/1993 | Bartasevich et al. | 222/214 |
| 5,271,560 | A | * | 12/1993 | De Winter | 239/42 |
| 5,598,952 | A | * | 2/1997 | Daansen | 222/105 |
| 5,632,418 | A | * | 5/1997 | Brown | 222/180 |
| 5,791,525 | A | | 8/1998 | Fan | |
| 5,944,227 | A | * | 8/1999 | Schroeder et al. | 222/144.5 |
| 6,082,593 | A | * | 7/2000 | Borcherds | 222/181.3 |
| 6,206,238 | B1 | * | 3/2001 | Ophardt | 222/1 |
| 6,318,600 | B1 | * | 11/2001 | Winnett et al. | 222/173 |
| 6,623,257 | B2 | * | 9/2003 | Taniguchi | 417/478 |
| 6,758,372 | B2 | * | 7/2004 | Studer et al. | 222/88 |
| 6,789,708 | B2 | * | 9/2004 | Hansen | 222/505 |
| 7,000,794 | B2 | * | 2/2006 | Soehnlen et al. | 215/398 |
| 7,066,356 | B2 | * | 6/2006 | Schuman et al. | 222/153.01 |
| 7,278,554 | B2 | * | 10/2007 | Armstrong | 222/325 |
| 7,651,010 | B2 | * | 1/2010 | Orzech et al. | 222/214 |
| 7,735,686 | B2 | * | 6/2010 | Ophardt | 222/136 |
| 8,042,711 | B2 | * | 10/2011 | Luechinger et al. | 222/325 |
| 8,091,740 | B2 | * | 1/2012 | Zur Muhlen | 222/181.3 |
| 8,308,027 | B2 | * | 11/2012 | Law et al. | 222/52 |
| 2003/0127470 | A1 | * | 7/2003 | DeKoning et al. | 222/180 |
| 2006/0249538 | A1 | * | 11/2006 | Ophardt et al. | 222/181.3 |
| 2007/0272708 | A1 | * | 11/2007 | Muhlen | 222/181.3 |
| 2008/0135578 | A1 | * | 6/2008 | Ophardt | 222/136 |
| 2010/0288792 | A1 | * | 11/2010 | Zur Muhlen | 222/181.3 |

FOREIGN PATENT DOCUMENTS

| | | | |
|---|---|---|---|
| SU | 41141 | | 1/1935 |
| SU | 249578 | | 6/1967 |
| SU | 1283342 | | 1/1987 |
| SU | 1625456 | | 2/1991 |
| WO | WO0040131 | A1 | 7/2000 |
| WO | WO03059524 | | 7/2003 |
| WO | WO2006010924 | | 2/2006 |
| WO | WO2006015973 | | 2/2006 |
| WO | WO2006015973 | A1 | 2/2006 |

* cited by examiner

DISPENSER SYSTEM

CROSS REFERENCE TO RELATED APPLICATIONS

The present application claims priority to PCT International Application No. PCT/EP2009/055278 filed on Apr. 30, 2009 which claims priority to German Patent Application Serial No. EP 10 2008 002 957.2 filed on Jul. 22, 2008.

STATEMENT RE: FEDERALLY SPONSORED RESEARCH/DEVELOPMENT

Not Applicable.

BACKGROUND

1. Technical Field of the Invention

The invention relates to a dispenser system for distributing in portions pasty, liquid, sprayable and/or foamed media, with a housing which can be mounted or placed on a wall and a reservoir cartridge held in the housing in a cartridge seating, from which reservoir cartridge a portion of the medium can be distributed in portions via a distribution device as a result of the actuation force of an actuation device applied manually or electrically. In one embodiment of the invention, the reservoir cartridge comprises a reservoir container with at least one supporting face counteracting the weight, the distribution device and a connection element connecting the distribution device to the reservoir cartridge, and the cartridge seating comprises at least one holding means connected to the housing, on which holding means the supporting face of the reservoir container can be placed in order to support the weight of the reservoir cartridge, and at least one abutment supporting the connection element or the distribution device against the actuation force.

Furthermore, the invention relates to a second embodiment of a dispenser system in which the supporting face and the holding means do not necessarily have to be provided, wherein the pressure for the distribution of the medium is generated manually or electrically by an actuation force by means of an actuation device disposed on the housing and can be transferred to a pressure-receiving region of the distribution device by means of a pressure-exerting region of the actuation device and the distribution device distributes a portion of the medium in portions as a result of this pressure.

2. Description of Related Art

Dispenser systems of this kind are generally known. Such dispenser systems usually comprise a housing with a rear wall which can be fixed to the wall of a room. Holding means for the fixing or holding of a reservoir cartridge are disposed on this rear wall, the employed reservoir cartridge being covered by a lid which is connected in the upper region of the rear wall usually in a swiveling manner.

In order to distribute a portion of the medium to be dispensed, an actuation device is provided which can be operated manually or electrically. In both cases, a pressing force presses on a distribution device, usually in the form of a pump, as a result of which the portion of the medium can as a rule be distributed downwards. The actuation device can be a separate push key, usually referred to as a "pushbutton", but in other embodiments of the dispenser the housing lid itself can be constituted such that it simultaneously forms the actuation device by means of its swivellable mounting, i.e. it acts with a section on the distribution device and can thus transfer a pressing force onto the housing.

Depending on the medium to be dispensed, the distribution device is as a rule designed in different ways. For example, a pump for the distribution of foam thus comprises a foaming device, which is also able to suck up air towards the originally liquid medium, wherein the air and the medium are then caused to swirl together and can thus be distributed in a foamed manner. Dispensers for gaseous media are usually pressureless, so that here too an originally liquid portion of the medium is mixed in the form of an aerosol with air by means of a suitable embodiment of the distribution device and is thus distributed, as it were, in gaseous form. The term gaseous in the sense of this application, therefore, is also understood to mean air flows wetted with liquids, the distribution of purely gaseous media via the distribution device, which is connected to a reservoir container filled under pressure, also of course falling within the scope of the invention.

The known dispensers are in each case capable of distributing the medium in a reliable and visually appealing manner. The drawback with the known dispensers, however, consists in the fact that a special dispenser device usually has to be designed for each kind of medium. This not only increases production costs, but also the storage costs, and it makes it difficult to retrofit a dispenser system which has already been installed with a customer for another medium. Thus, for example, in the case of changing a soap dispenser from a liquid dispenser to a dispenser that is capable of distributing foamed soap, it is often necessary to replace the whole dispenser or at least several parts thereof. A simple replacement of the medium, therefore, is usually not possible for the customer or is at least bound up with considerable cost, which markedly restricts the customer's freedom of decision regarding the media used.

BRIEF SUMMARY OF THE INVENTION

The problem of the invention, therefore, is to provide a dispenser system with which as large a number of media as possible can be distributed at production costs as low as possible. The aim of the invention is to provide a universal dispenser for the greatest possible range of media.

According to a first aspect of the invention, this problem is solved by the fact that the dispenser system is designed as an identical part system for the construction of dispensers for pasty, liquid, sprayable and/or foamed media, wherein the cartridge seating and the reservoir cartridge are designed for this purpose in such a way that the distance of the actuation device and the counter-bearing from the supporting face or the supporting faces is equal.

According to a further aspect of the invention, this problem is solved in respect of the second embodiment of the invention by the fact that the dispenser system is also designed as an identical part system for the construction of dispensers for different, in particular pasty, liquid, sprayable and/or foamed media, wherein, for this purpose, the actuation device comprises at least two pressure-exerting regions and the distribution device of a first reservoir cartridge comprises a first pressure-receiving region and the distribution device of a second reservoir cartridge comprises a second pressure-receiving region which, after insertion of the reservoir cartridge into the dispenser, cooperate in each case with only one of the pressure-exerting regions. The pressure-exerting regions and the reservoir cartridges are designed here in such a way that at least two types of reservoir cartridge can be inserted into the cartridge seating and, at different positions depending on the design and/or length of the reservoir cartridge, either a first pressure-exerting region comes into contact with the first pressure-receiving region of the first reservoir cartridge or a second pressure-exerting region comes into contact with the second pressure-receiving region of the second reservoir cartridge at the latest during the actuation motion for the transfer of the actuation force.

The dispenser system according to the invention is characterised in that reservoir cartridges for very different media can be used by one and the same dispenser system. The customer acquires the reservoir cartridge, which comprises the reservoir container and the distribution device. Depending on the consistency of the medium to be distributed, however, the cost of the construction of this distribution device differs. Thus, for example, the aforementioned foam pumps must comprise additional means for sucking up air and for causing this air to swirl together with the originally liquid medium in the reservoir container. The same applies to pumps which are intended to distribute an aerosol, the medium present in the reservoir container, here too, also being originally liquid. A purely liquid pump, on the other hand, requires only the given pump means, i.e. it must only make available the height of lift for the pump chamber. Usually, therefore, a foam pump will have a greater length than a purely spray pump.

In the case of most dispensers, however, there is the problem that the actuation motion for the distribution device takes place at right angles to the wall surface on which the dispenser is mounted, whereas the distribution direction is directed vertically downwards. The effect of this is that the actuation force presses against the distribution device. In order that the pumping motion can take place, either the reservoir cartridge has to be mounted so rigidly in the housing and has to be designed so stable that it can accommodate the pressing force and does not shift downwards, or the distribution device has to be able to be supported inside the housing on the counter-bearing. For cost reasons, the first alternative usually does not come into consideration with a dispenser system. The second alternative, however, leads to the problem that the position of the counter-bearing inside the housing is fixed, so that the distance of the actuation device, i.e. the pushbutton for example, from the counter-bearing is also rigidly defined.

The reservoir cartridge is usually inserted into the housing, wherein it rests with at least one supporting face on a corresponding support face. This supporting face is preferably disposed in the region of the centre of gravity of the reservoir container or above the latter. In this way, the reservoir container, stabilised by its weight, can be suspended in the housing. Depending on the design of the distribution device, the latter extends in the direction of the supporting face over different distances. In order that the greatest possible variation of distribution devices can be used, the reservoir cartridge is designed according to the invention in such a way that the distance between the supporting face on the one hand and the counter-bearing or the actuation device on the other hand is equal. In this way, distribution devices of differing size can be used in one and the same dispenser.

It is particularly lucrative if the reservoir cartridges comprise in each case a reservoir container with identical dimensions, irrespective of the type of medium to be distributed and the design of the distribution device. In order that, as a result of the preset position of the distribution device, the reservoir cartridge can still be inserted into the housing, the connection element is designed in such a way that it can compensate for the different geometries of the different actuation devices. This connection element can be designed as a separate component, but it can also be a part connected to the reservoir container and also alternatively to the distribution device, i.e. a part of this assembly. The distribution device can be designed in the most diverse ways.

Thus, in the case of a pump for example, it is possible for the actuation force to be exerted normal to the housing rear wall and for it to be deflected inside the distribution device or inside the housing, so that the direction of motion of the pump means is orientated in the vertical direction parallel to the housing rear wall. The counter-bearing can be supported directly on the distribution device; alternatively, the connection element can also be interposed. In this case, the connection element must of course be sufficiently rigid, in order that it can support the pressing force at least with an adequate section. In an alternative embodiment of the distribution device, the pump means can also be moved horizontally in the actuation direction of the actuation device. A distribution of the medium can also take place downwards here; alternatively, the medium can of course be distributed in the horizontal direction, for example via a distribution channel.

Insofar as the actuation device is a pushbutton and this pushbutton is formed in front of the housing lid disposed in a swiveling manner at the rear wall, it is expedient for the hinge, by means of which the housing lid is jointed to the rear wall, to comprise at least one latching means. By this means, the angular segment over which the closed housing lid can be moved can be limited in such a way that the housing lid can only complete the actuation motion. Only after manual release of the latch-type locking device can the housing lid then be swung up further in order to replace the reservoir cartridge. Such an embodiment can be achieved for example by the fact that at least one spring-loaded latching nose is provided in the housing, said latching nose first being displaced by a latching edge against the elastic spring force when the housing lid is closed and then engaging behind the latching edge.

Such a latching edge can be formed by an edge projecting from the housing lid, the latching nose being able to be forced back against the spring direction in order to open the housing and to swivel the housing lid into the refilling position from below or through a slot with a special tool or a standard screwdriver, so that the latch-type connection becomes disengaged and the housing lid can be swivelled up. It is of course also possible to provide on the housing lid or on the housing rear wall a sliding element or a rotary knob, which acts mechanically on the locking device in such a way that, as a result of an appropriate actuation, the locking device can be released. Especially in the case of a rotary knob, the latter can be designed such that it can be operated only with a special tool.

A further embodiment of the invention, which can also be used independently of the features described above, is characterised in that the difference lengths of the distribution device are compensated for by the fact that the actuation device comprises at least two regions, via which the applied pressure can be transferred from the actuation device to the distribution device. For this purpose, two pressure-exerting regions of the actuation device are provided, which are disposed offset from one another in the actuation direction. Depending on which distribution device is used, the one or the other pressure-exerting region is used to transfer the actuation force. In order to achieve this, the distribution devices comprise different pressure-receiving regions, via which the pressure of the actuation device is transferred to the corresponding elements of the distribution device.

A first pressure-exerting region thus communicates with a first pressure-receiving region of the distribution device, whilst a second pressure-exerting region of the actuation device can come into contact with a second pressure-exerting [sic!] region of the distribution device. The distribution device is however designed in each case such that only the respective regions engage with one another.

The embodiments described above can be obtained, for example, by the fact that the actuation device comprises a recess on the inner side. The bottom of this recess is then that the second pressure-exerting region, whilst that the region around this recess represents the second pressure-exerting region. A first distribution device comprises, as a pressure-receiving region, a press ram which projects into the recess. The second distribution device, which for example, because it is somewhat shorter, is used for the distribution of a liquid medium, comprises on the other hand a broader press ram, which is capable of abutting against the annular space around the recess. In this way, distribution devices of differing length can be used with one and the same dispenser housing.

Self-evidently, apart from the described two pressure-exerting and pressure-receiving regions, it is also possible to provide a plurality of these regions in order to be able to use other distribution devices with the universal dispenser. Alternatively, the recess can also be closed by a ram, which then has to be removed when use is made of longer distribution devices. However, this has the drawback that the inside of the housing lid or of the actuation device first has to be manually prepared for the use of a special reservoir cartridge, which is not only associated with additional work, but can also increase the frequency of errors.

In an alternative dispenser system, the pressure-exerting and the pressure-receiving region can also be moved vertically. This can be achieved for example by the fact that a force deflection of the pressing force generated by the actuation device moved in the direction of the housing rear wall first takes place. Alternatively, the actuation device can of course also act directly in the vertical direction. The pressure-exerting and pressure-receiving regions can of course also be provided on intermediate elements, which are interposed as force transfer elements between the actuation device and the distribution device.

A further embodiment of the dispenser system is constituted by the fact that, on the inner side of the pushbutton, accommodation for a pressure piece is provided, which is disposed in a slidable or rotatable manner at the inner side of the pushbutton. This pressure piece has two faces, which can be activated as pressure-exerting faces by the sliding or rotation. Depending on the geometry of the reservoir cartridge, in particular the distribution device, the one or the other pressure-exerting face can be activated, this being able to take place either manually when the reservoir cartridge is inserted or alternatively a thread-in aid can be provided which, when the housing lid is folded to, brings about an independent rotation or displacement of the pressure piece, so that a particular adjustment does not have to be carried out by the user performing the refill. The latter-mentioned embodiment is of course particularly preferable with a view to avoiding incorrect operator controls, wherein such a thread-in aid can be formed by ramps on the distribution device, wherein the pressure piece slides away with contact faces onto these ramps and the ramps are disposed in such a way that they bring about the displacement of the pressure piece as a result of the swiveling motion.

Reservoir cartridges of the most diverse kinds can be used in the dispenser system according to the invention. They can for example be reservoir cartridges for distributing pasty or liquid media, reservoir cartridges for the foamed distribution of liquid media contained in the reservoir container or also reservoir cartridges for the distribution of sprayable media, these being able to be aerosols or gases which are distributed from a pressureless reservoir container or a reservoir container under pressure. In the case of all reservoir cartridges, the reservoir container preferably has the same dimensions, so that the shape of the distribution device, in particular the geometrical variations, can be compensated for by the connection element.

The centre of gravity of the supporting face, with which the reservoir container rests on the support of the housing, is preferably disposed at least at the height of the centre of gravity or above the latter, so that the whole reservoir cartridge can be suspended in a self-stabilising manner in the housing. In this way, the housing can be operated with one hand, since the person carrying out the refilling merely has to open the housing lid and can then insert the reservoir cartridge into the opened housing lid. In order to facilitate this insertion, the housing lid swivelled upwards can be held open by a spring force.

The reservoir container can comprise a supporting face, which is preferably formed by two opposite-lying partial faces which cooperate with corresponding holding faces on the housing rear wall. A plurality of supporting faces disposed one above the other can of course also be provided, each housing then comprising a corresponding number of holding faces; alternatively, it is also possible for only one of the holding faces of the housing to engage with the seatings, so that the reservoir container can be inserted into the housing at different heights depending on the distribution device used.

In a further embodiment of the dispenser, a plurality of holding means are provided in the housing, only one or only some of the holding means cooperating with the supporting faces of the reservoir container. The different reservoir containers of the various reservoir cartridges can be designed here in such a way that, in each case, they can be placed on only one holding means or only a pair of holding means lying opposite, wherein the wall of the reservoir container is pulled in sufficiently far below and/or above this fixing position, so that the other holding means remain inactive.

The connection element connects the distribution device to the reservoir container, i.e. it represents the flow connection for the medium to be distributed. Depending on the design of the distribution device, which usually can be formed by a liquid pump or a foam pump, the connection element can convey the flow of the medium vertically downwards or also deflect it at right angles to the side or forwards. The connection element itself can be formed by a rigid channel which has a suitable geometry. Alternatively, the connection element can also be a flexible hose or a combination of a rigid channel and a flexible hose segment. Furthermore, the connection element can also be part both of the reservoir container and, alternatively, part of the distribution device.

In order to form the counter-bearing, there is provided in the housing a suitable face on which either the distribution device or the connection element can be supported, provided there is a suitably rigid wall formation. If, for example, a pump is used as the distribution device, which pump with a pump body running at right angles to the rear wall of the housing extends up to the rear wall, the counter-bearing can be formed by a section of the housing against which this region of the distribution device can be supported. Alternatively, a separate support can be provided, which projects from the housing rear wall in the direction of the distribution device or the connection element and laterally or obliquely supports the connection element or the distribution device.

Especially when the holding means and the seating of the reservoir container are designed in such a way that the reservoir container can be inserted at a plurality of heights, or when the connection element is designed in such a way that, with a uniform insertion height of the reservoir container into the housing, any height differences of the distribution device can be compensated for by the connection element, the same reservoir container can always be used with the identical part concept according to the invention. This has the particular advantage that not only can the dispenser housing, the housing lid and the actuation device remain the same, but also identical reservoir containers can then be used to constitute the individual reservoir cartridges. The connection element then merely has to be adapted to the given intended application, the distribution device usually being a ready-compensated pump element available on the market as a low-cost component. As a result of the invention, a particularly cost-effective identical part concept can thus be achieved.

Finally, the housing can be further adapted to different intended uses, wherein the housing also comprises in the upper region a passage for distribution means, so that the same housing can also be used when the reservoir cartridge is inserted into the housing essentially turned round with the distribution device pointing upwards. In this case, the distribution device, such as is known for example from an upright standing soap dispenser, can comprise an upper distribution channel, which is pressed by the user to distribute the medium. The upper passage of the housing can be closed by means of a suitable stopper if this embodiment is not desired.

Further features and advantages of the invention emerge from the sub-claims and from the following description of preferred examples of embodiment with the aid of the drawings.

BRIEF DESCRIPTION OF THE DRAWINGS

These and other features and advantages of the various embodiments disclosed herein will be better understood with respect to the following description and drawings, in which like number refer to like parts throughout, and in which.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

DETAILED DESCRIPTION

Figure 1:
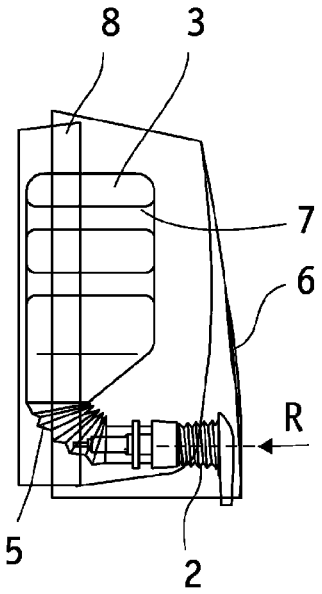
FIG. 1 shows a first embodiment of a dispenser system in a schematic side view in cross-section.
Figure 2:
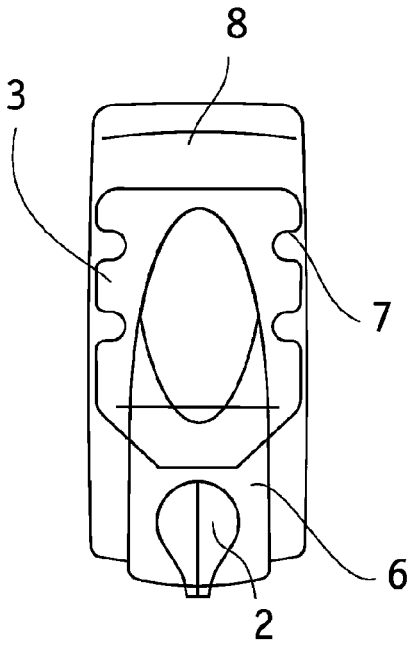
FIG. 2 shows the dispenser system according to FIG. 1 in a plan view.
Figure 3:
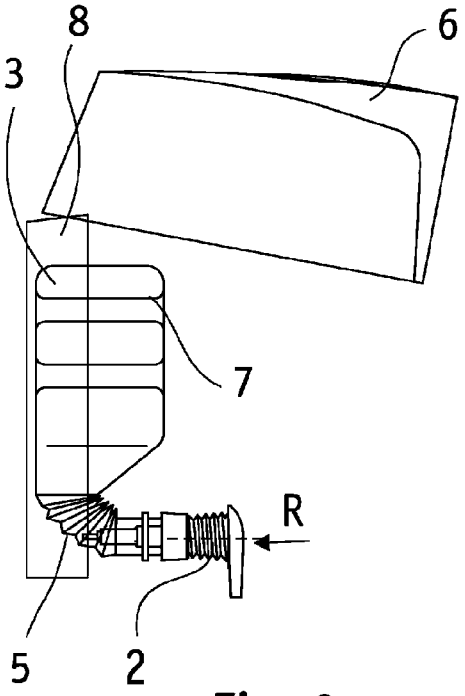
FIG. 3 shows the dispenser system from FIGS. 1 and 2 in a schematic side view with the housing lid swung open.
Figure 4:
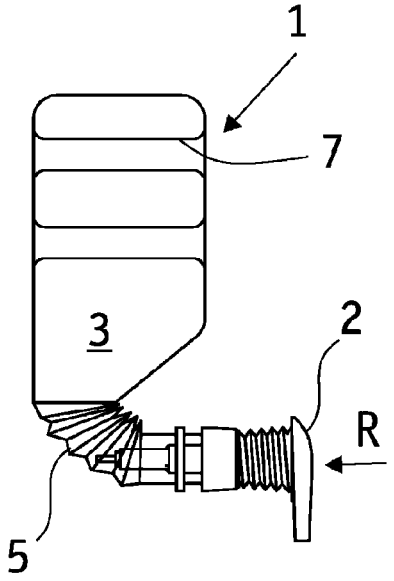
FIG. 4 shows a reservoir cartridge, which can be used in connection with the dispenser systems according to FIGS. 1 to 3.

A first dispenser system is represented in FIGS. 1 to 4. In this dispenser system, a reservoir cartridge 1 is inserted into a housing 8. Said reservoir cartridge is represented in FIG. 4 in a detail drawing.

Reservoir cartridge 1 comprises a reservoir container 3, which comprises supporting faces 7 on both sides. In the example of embodiment shown, reservoir container 3 comprises two supporting faces 7. In the lower region, reservoir container 3 is connected to a connection element 5, which in turn is connected to distribution device 2.

Distribution device 2 can be operated by the user by applying a manual pressing force in actuation direction R for the distribution of a defined volume of a medium. For this purpose, the housing lid of housing 8 is designed as actuation device 6. This means that the housing lid is connected in a swiveling manner in the upper region of housing 8 to the housing rear wall, the lower region of the housing lid been designed as a pushbutton, in that it abuts with its inner side against distribution device 2. Furthermore, the housing lid abuts against distribution device 2.

When distribution device 2 is compressed in actuation direction R . . . swivellable through several angles, i.e. farther in the direction of the rear wall of housing 8. This compression of distribution device 2 then leads to the distribution of the medium in portions. Reservoir container 3 cooperates with holding means 10 which are disposed in the housing rear wall, wherein supporting faces 7 of reservoir container 3 are supported on holding means 10 in order to hold reservoir container 3 in the vertical direction. The position of holding means 10 is best represented in FIG. 5, which shows a further embodiment of a reservoir cartridge in combination with a similar housing.

Figure 5:
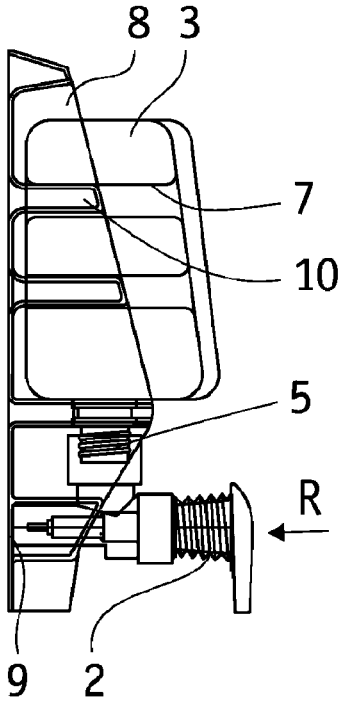
FIG. 5 shows an alternative reservoir cartridge for use in a dispenser system according to FIGS. 1 to 3, inserted into the housing rear wall.
Figure 6:
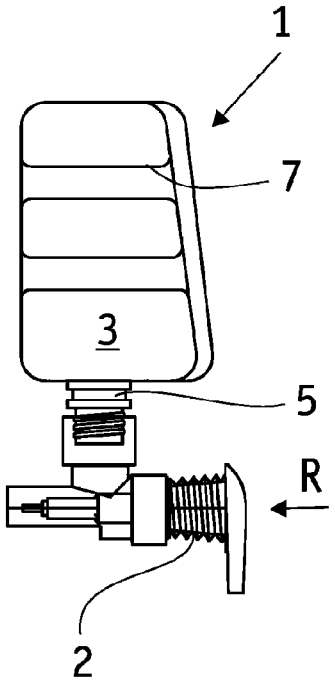
FIG. 6 shows the reservoir cartridge from FIG. 5 in a detail view.

The embodiment of the reservoir cartridge according to FIGS. 5 and 6 differs from the embodiment according to FIGS. 1 to 4 by the fact that connection element 5 for connecting distribution device 2 to reservoir container 3 is designed as a simple connection piece with a rigid wall, distribution device 2 comprising a T-shaped connecting pipe. In contrast with this, in the embodiment previously described according to FIGS. 1 to 4, connection element 5 is designed as a flexible hose which likewise produces a right-angled flow reversal of the medium conveyed from reservoir container 3 in the direction of distribution device 2.

Figure 7:
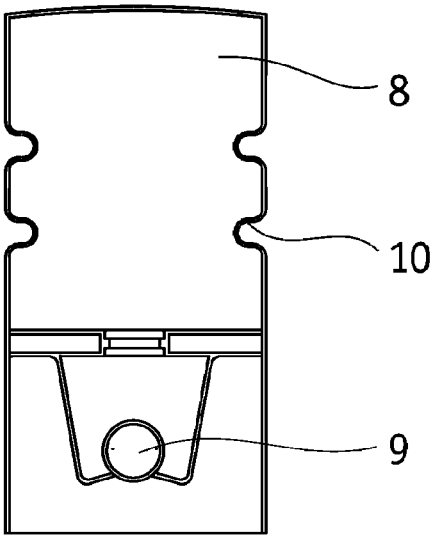
FIG. 7 shows a plan view of the housing rear wall of the dispenser system according to FIG. 5.

In the embodiment of the dispenser system represented in FIGS. 5 and 6, distribution device 2 is supported against a rear counter-bearing 9, which is formed by a wall region of the housing rear wall. This counter-bearing 9 can be seen particularly well in FIG. 7, in which the housing rear wall is reproduced in a component-part representation without reservoir cartridge 1. A lateral displacement of distribution device 2 and thus slipping away from counter-bearing 9 are prevented by an annular projection, into which distribution device 2 projects with a rear extension.

Figure 8:
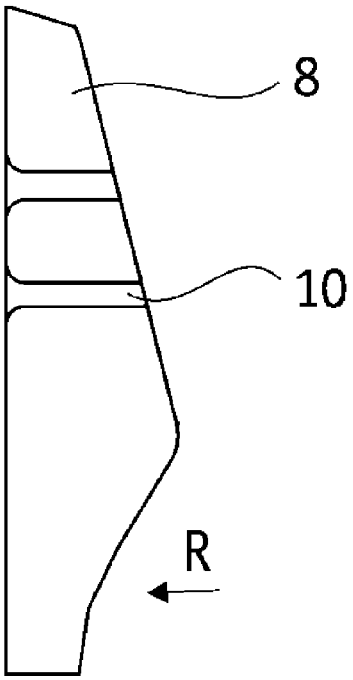
FIG. 8 shows a side view of the housing rear wall from FIG. 7.

In contrast with this, in the embodiment of the dispenser system represented in FIGS. 1 to 4, counter-bearing 9, which is not represented here, has to be formed either by a holding element disposed in the region of distribution device 2 or by a fairly long spacer, which can then also be connected to the housing rear wall. FIG. 8 shows the housing rear wall of the second embodiment of the dispenser system in a component-part representation, wherein holding means 10 of housing 8 for accommodating seating 7 is designed here as an upper region of an edge of the rear wall of housing 8 that projects from the wall.

Figure 9:
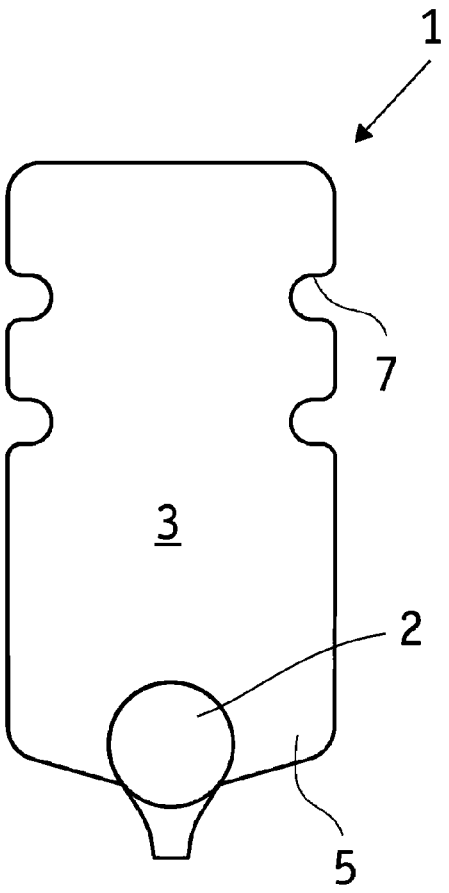
FIG. 9 shows a reservoir container of a further embodiment of a dispenser system with placed-on actuation device.

FIGS. 9 to 14 reproduce two similar kinds of reservoir cartridge in component part representations. FIG. 9 shows a first reservoir cartridge, which comprises a reservoir container 3, which comprises respectively at its right-hand and left-hand side wall two supporting faces 7 lying opposite corresponding supporting faces 7. Distribution device 2 in the form of a liquid pump is disposed in the lower region. Connection element 5 between reservoir container 3 and distribution device 2 is designed here as an extension of reservoir container 3, which is connected intergrally and in one piece to reservoir container 3.

Figure 10:
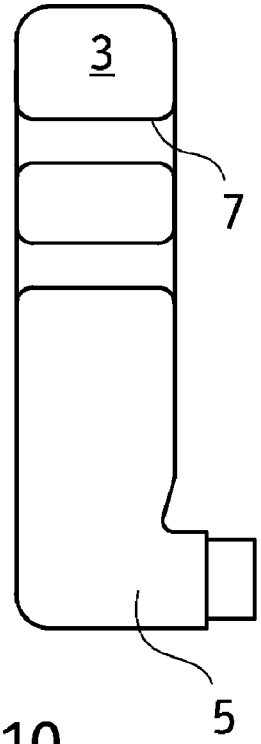
FIG. 10 shows the reservoir container or actuation device from FIG. 9.
Figure 11:
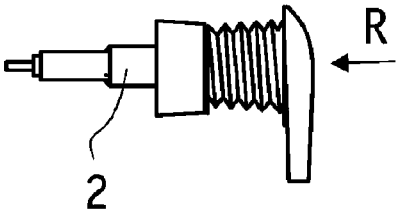
FIG. 11 shows the actuation device from FIG. 9.
Figure 12:
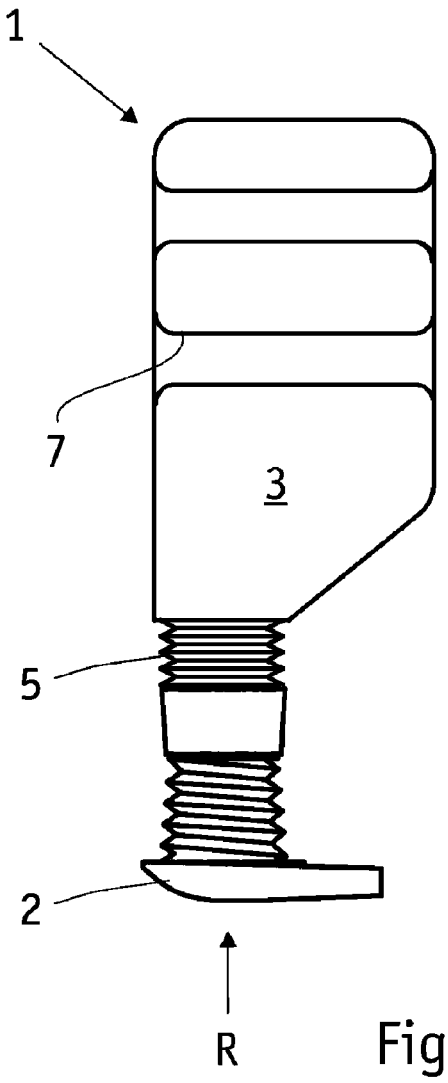
FIG. 12 shows the assembled reservoir container according to FIGS. 9 to 11 in a side view.

FIG. 10 shows reservoir container 3 without distribution device 2 from FIG. 9 in a side view, wherein in particular the design of connection element 5 can be seen here as an extension and a rectangularly bent-off channel. FIG. 11 represents in a component-part view of distribution device 2 from FIG. 9, which is represented in FIG. 10. Here, it involves a standard liquid pump, such as is already used in the prior art.

Figure 13:
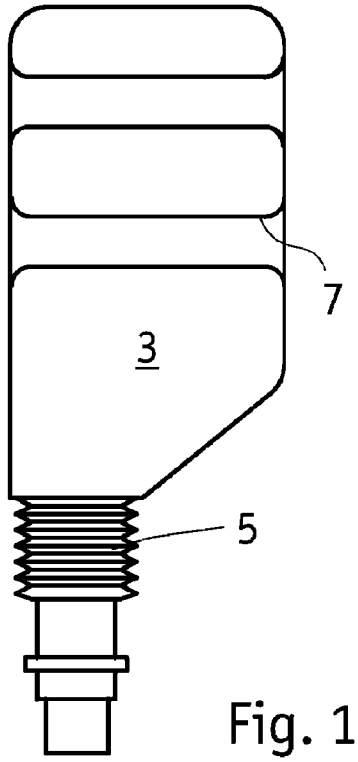
FIG. 13 shows the reservoir container from FIG. 12 in an isolated representation.
Figure 14:
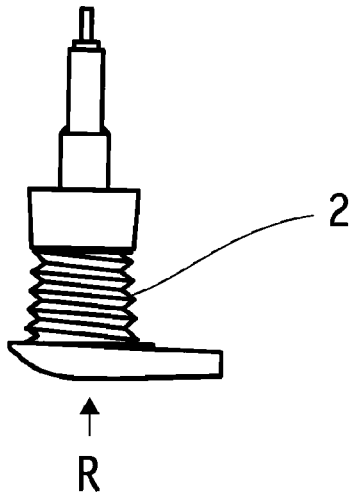
FIG. 14 shows the actuation device from FIG. 12 in an isolated representation.

FIGS. 13 to 14 show another embodiment, wherein the sole difference here consists in the fact that connection element 5 is designed as a channel which runs rectilinearly downwards and which is also connected integrally to reservoir container 3. In contrast with the embodiment according to FIGS. 9 to 11, actuation direction R is therefore directed vertically upwards here, whereas in the case of the embodiment represented above it is orientated horizontally in the direction of the housing rear wall.

FIGS. 15 to 19 represent schematically a dispenser system which also comprises a housing 8 into which a reservoir cartridge 1 can be inserted, wherein housing 8 comprises for this purpose holding means 10 on which reservoir container 3 can be placed with supporting face 7.

Figure 15:
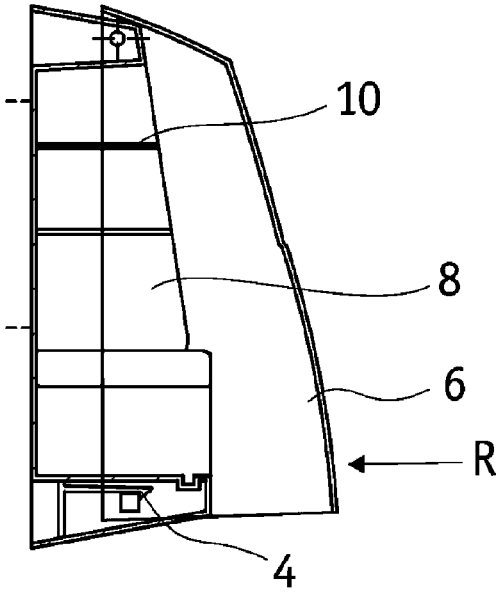
FIG. 15 shows a representation of a housing for a dispenser system with a housing lid used as an actuation device.

In this embodiment, the lid of housing 8 simultaneously forms actuation device 6, wherein the lower part of the lid of housing 8 can for this purpose be placed against distribution device 2 (not represented here) of reservoir cartridge 1 (also not represented here). FIG. 15 shows the rest state of the dispenser system without an inserted reservoir cartridge. In the lower region, a square projection is provided on the side wall of the housing lid, said projection being engaged from the rear by a counter-bearing hook in such a way that it forms a locking device 4 against further swiveling of the housing lid in the upwardly directed direction.

Figure 16:
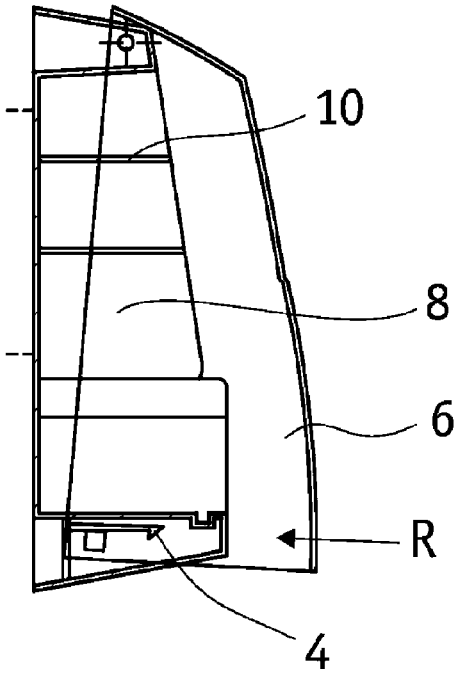
FIG. 16 shows the housing from FIG. 15 in which the housing lid is located in the dispensing position.

In contrast, the housing lid can be swivelled in the clockwise direction through several degrees in the direction of the housing wall, distribution device 2 being actuated by this further swiveling in the direction of the housing rear wall when reservoir cartridge 1 is inserted. FIG. 16 shows this state with compressed distribution device 2 (not represented here). It can be seen here that the rectangular projection is displaced by the counter-bearing edge of locking device 4 by the further swiveling of the lid of housing 8 in the direction of the housing rear wall. The lower part of the housing lid thus acts as actuation device 6.

Figure 17:
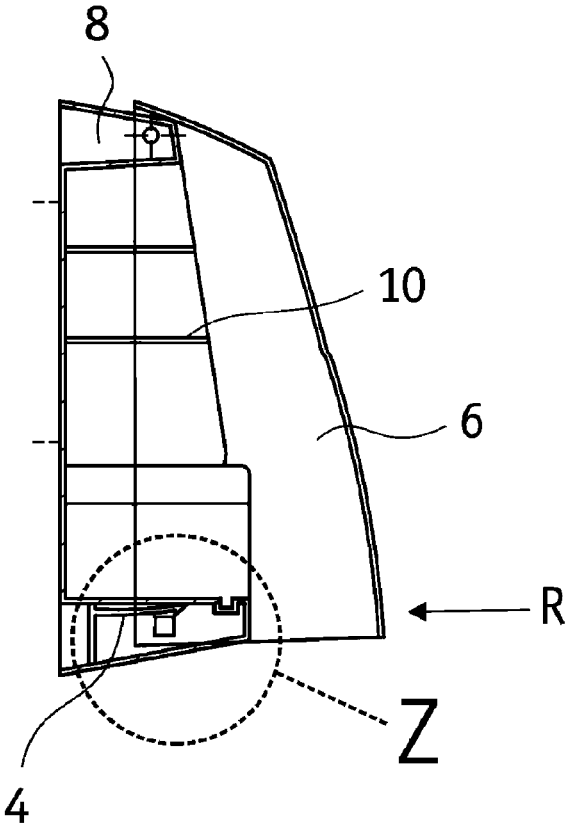
FIG. 17 shows the housing from FIG. 15 with deactivated locking device.
Figure 18:
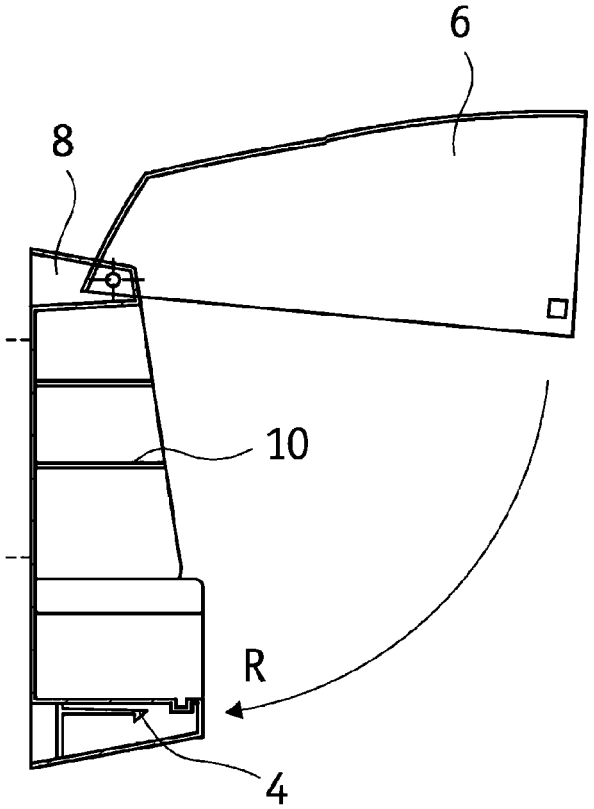
FIG. 18 shows the housing from FIGS. 15 to 17 with the housing lid swung out.

FIG. 17 represents the same position of the housing lid which is also represented in FIG. 15. Here, however, locking device 4 is already deactivated by an external pressure from below. The effect of this is that the housing lid can be swivelled upwards manually against the force of a suitable spring into a filling position, which is represented in FIG. 18.

Figure 19:
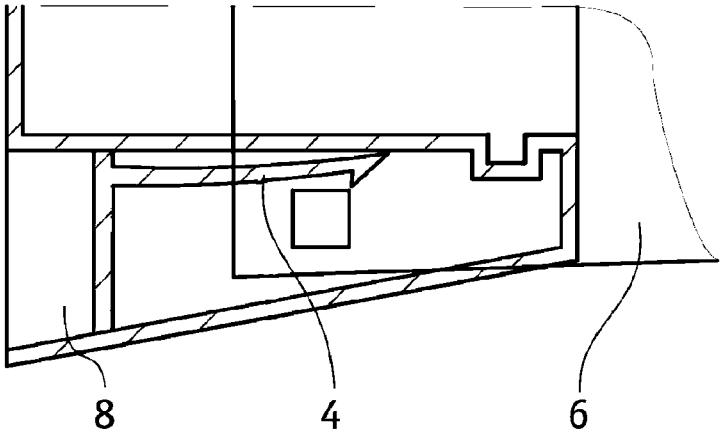
FIG. 19 shows detail Z from FIG. 17 to represent the deactivation of the locking device.
Figure 20:
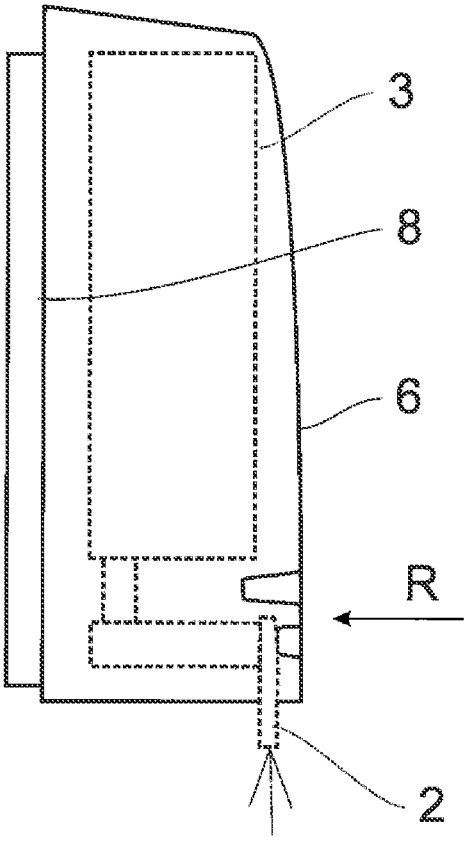
FIG. 20 illustrates a foam dispenser and an offset of second pressure exerting regions.
Figure 21:
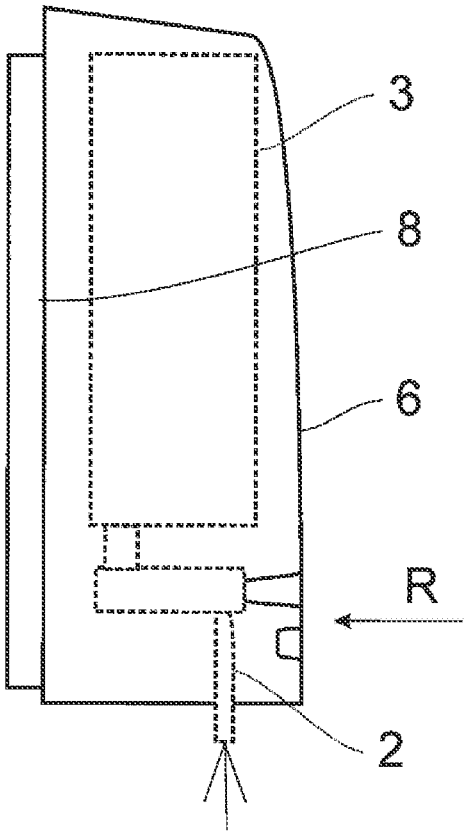
FIG. 21 illustrates a liquid dispenser and an offset of second pressure-exerting regions.
Figure 22:
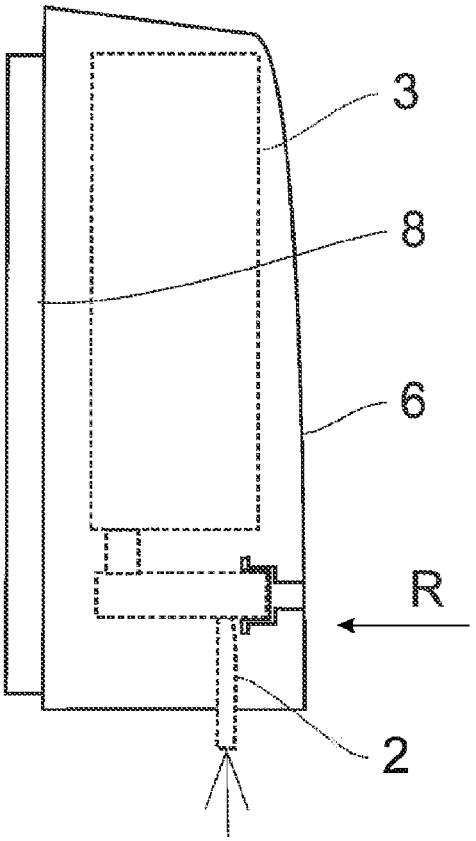
FIG. 22 illustrates a recessed region.
Figure 23:
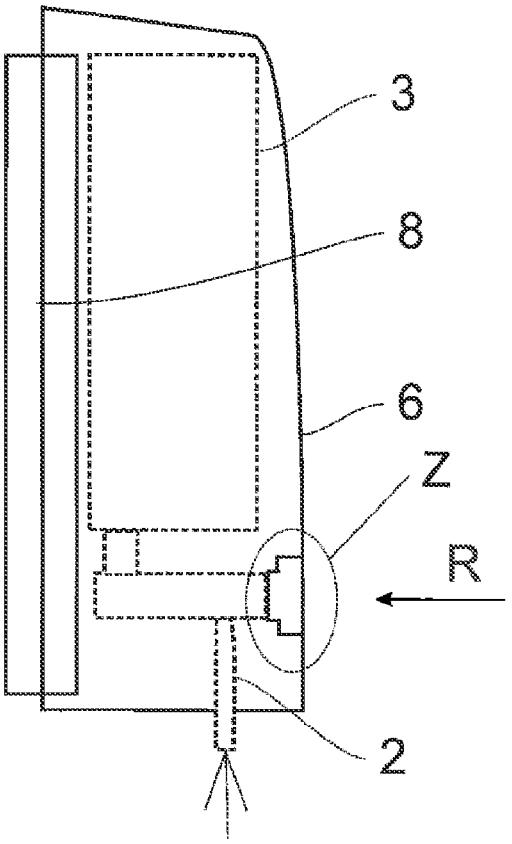
FIG. 23 illustrates a raised region.
Figure 24:
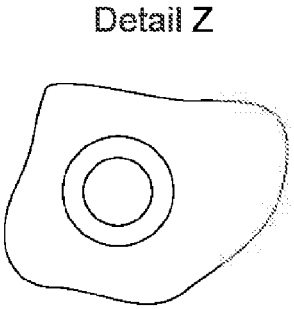
FIG. 24 illustrates a type of raised or recessed region.
Figure 25:
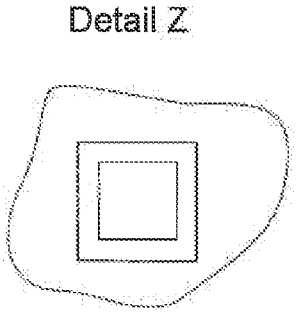
FIG. 25 illustrates another type of raised or recessed region.
Figure 26:
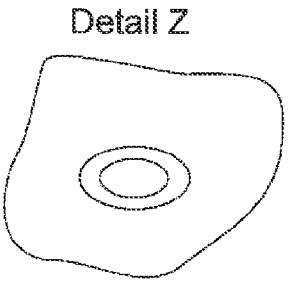
FIG. 26 illustrates another type of raised or recessed region.
Figure 27:
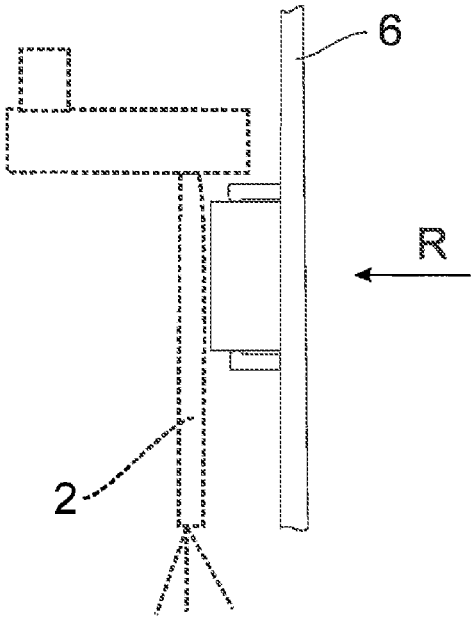
FIG. 27 illustrates a clip on an inner side for attaching a pressure-exerting piece.
Figure 28:
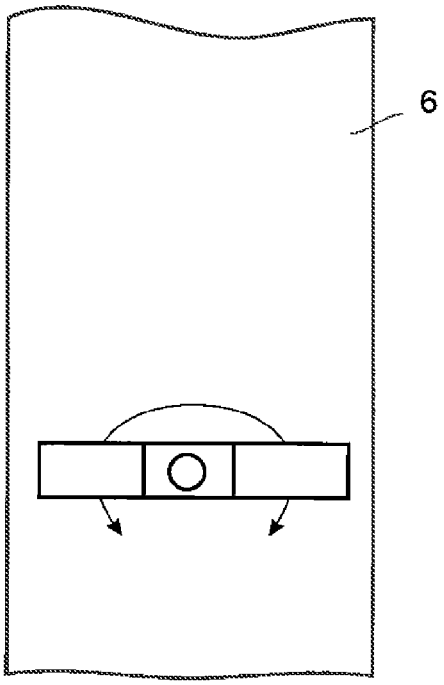
FIG. 28 illustrates a rotatable element rotatably mounted on an inner side of a pushbutton.
Figure 29:
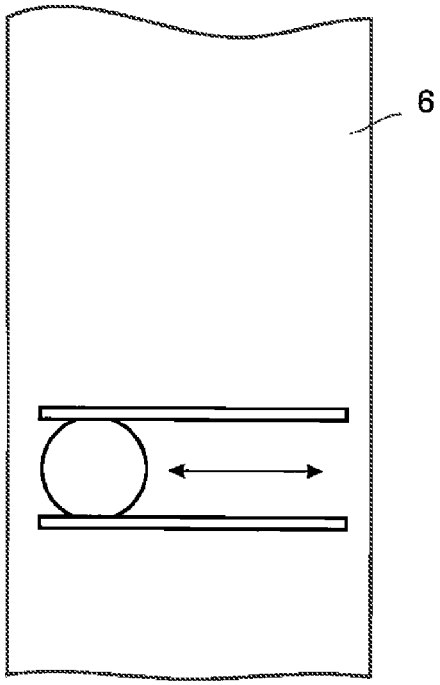
FIG. 29 illustrates a slideable embodiment of that shown in FIG. 28.
Figure 30:
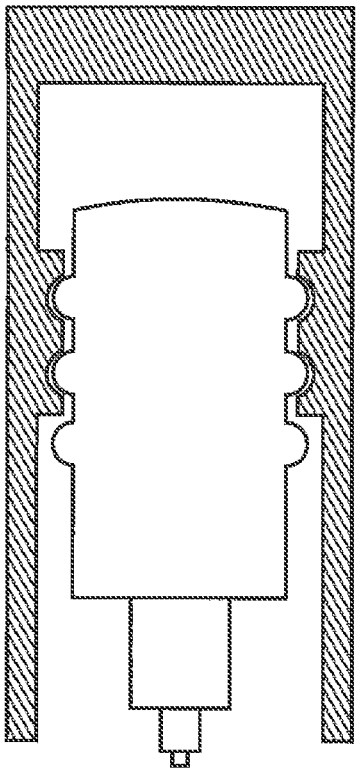
FIG. 30 illustrates a reservoir container capable of being inserted into the housing at different heights.

FIG. 19 in turn represents, in an enlarged detail view, the release of locking device 4, which is indicated in FIG. 17 with detail Z. It can be seen that locking device 4 is formed by an elastic hook connected to the housing rear wall and the blocking element of the housing lid cooperating therewith, said blocking element being constituted here in a square shape. The hook projecting in the direction of the housing lid is pushed upwards in order to release locking device 4, so that the counter-bearing region of the hook can no longer engage behind the edge of the square-shaped locking device.

Locking device 4 represented in FIG. 19 is of course a detail design, the invention also being intended to include all other forms of releasable locking devices which, particularly with a counter-bearing edge, oppose the swiveling up of the housing lid into the filling position, wherein the counter-bearing edge can be disengaged by the application of an external force. For the application of this external force, there can be provided either on the housing rear wall or on the housing lid rotary or sliding means, by which the person carrying out the filling can deactivate the locking device either directly or after applying a tool. Furthermore, it is of course also possible for the locking device to be pushed upwards from beneath, for example by the application of a spike or screwdriver or even with the fingers.

The invention claimed is:

1. A dispenser system for dispensing two different types of media, the dispenser system comprising:

a housing arrangeable on a wall, the housing having a body, an abutment defining first and second pressure exerting regions and an actuation device, the body formed with first and second horizontally oriented protrusions on an interior of the body, the first and second horizontally oriented protrusions being vertically disposed on the interior of the body, the actuation device being traversable with respect to the body;

a first reservoir cartridge having a reservoir container, a distribution device and a connection element, the distribution device dispenses a first media upon application of an actuation force on the actuation device of the housing, the reservoir container of the first reservoir cartridge having a supporting face engagable to either the first or second horizontally oriented protrusions to vertically position the first reservoir cartridge within the housing to align the connection element or the distribution device with the abutment of the housing, the connection element connecting the distribution device to the reservoir container of the first reservoir cartridge, the connection element or the distribution device disposed against the abutment of the body of the housing upon application of the actuation force on the actuation device;

wherein the housing is configured to receive the first reservoir cartridge for dispensing the first media or a second reservoir cartridge for dispensing a second media which is different from the first media;

wherein the first pressure exerting region contacts a first pressure receiving region defined by the distribution device of the first reservoir cartridge for dispensing the first media or the second pressure exerting region contacts region defined by the distribution device of the second reservoir cartridge for dispensing the second media;

wherein the actuating device has the first and second pressure exerting regions disposed adjacent to each other so that the distribution device is aligned to the first pressure exerting region when the supporting face engages the first horizontally oriented protrusion and the distribution device is aligned to the second pressure exerting region when the supporting face engages the second horizontally oriented protrusion;

wherein the first or second reservoir cartridge is insertable into the housing so that a distribution opening of the reservoir container is disposed at an underside of the reservoir container and the actuation device is configured so that the actuation force is directed at an angle to a vertical direction, wherein the first pressure-exerting region and the second pressure-exerting region are each traversable horizontally backwards in a direction of a housing rear wall by the actuation device and the first pressure-exerting region is offset from the second pressure-exerting region in the actuation direction (R).

2. A dispenser system for dispensing two different types of media, the dispenser system comprising:

a housing arrangeable on a wall, the housing having a body, an abutment defining first and second pressure exerting regions and an actuation device, the body formed with first and second horizontally oriented protrusions on an interior of the body, the first and second horizontally oriented protrusions being vertically disposed on the interior of the body, the actuation device being traversable with respect to the body;

a first reservoir cartridge having a reservoir container, a distribution device and a connection element, the distribution device dispenses a first media upon application of an actuation force on the actuation device of the housing, the reservoir container of the first reservoir cartridge having a supporting face engagable to either the first or second horizontally oriented protrusions to vertically position the first reservoir cartridge within the housing to align the connection element or the distribution device with the abutment of the housing, the connection element connecting the distribution device to the reservoir container of the first reservoir cartridge, the connection element or the distribution device disposed against the abutment of the body of the housing upon application of the actuation force on the actuation device;

wherein the housing is configured to receive the first reservoir cartridge for dispensing the first media or a second reservoir cartridge for dispensing a second media which is different from the first media;

wherein the first pressure exerting region contacts a first pressure receiving region defined by the distribution device of the first reservoir cartridge for dispensing the first media or the second pressure exerting region contacts region defined by the distribution device of the second reservoir cartridge for dispensing the second media;

wherein the first or second reservoir cartridge is insertable into the housing so that a distribution opening of the reservoir container is disposed at an underside of the reservoir container and the actuation device is configured so that the actuation force is directed at an angle to a vertical direction, wherein the first pressure-exerting region of the actuation device and the second pressure-exerting region of the actuation device are each traversable horizontally backwards in a direction of a housing rear wall by the actuation device and the first pressure-exerting region is offset from the second pressure-exerting region in the actuation direction (R).

3. The dispenser system of claim 2, wherein the connection element is part of the reservoir container or part of the distribution device.

4. The dispenser system of claim 3, wherein the actuation device is a housing lid connected to the housing with the rear wall in an articulated manner by at least one hinge, wherein the housing lid and the rear wall form boundaries of an interior space of the dispenser and the housing lid defines the actuation device and wherein the housing comprising at least one latch comprising an end stop formed on the housing lid and a locking pawl, wherein when the housing lid is folded shut in the latching position after insertion of the reservoir container, the end stop engages the locking pawl.

5. The dispenser system of claim 4 wherein the at least one latch is manually or automatically activated when the housing lid is folded shut in the latching position after insertion of the reservoir container to prevent swiveling-back of the housing lid beyond the latching position until the at least one latch has been disengaged, wherein when the housing lid is traversed to the latching position, the locking pawl engages behind a retaining edge of the end stop so that the housing lid can be traversed to an open position only after pressing the locking pawl over the retaining edge of the end stop.

6. The dispenser system of claim 5, wherein the locking pawl can be opened with a key or with a tool for deflecting the pawl away from the end stop.

7. The dispenser system of claim 2 wherein the first pressure-exerting region and the second pressure-exerting region are defined by a pushbutton, wherein an inner side of the pushbutton facing the reservoir container forms the first pressure-exerting region and a recessed region of the inner side of the pushbutton forms the second pressure-exerting region.

8. The dispenser system of claim 2 wherein the first pressure-exerting region and pressure elements of the second pressure-exerting region are defined by of a pushbutton, wherein an inner side of the pushbutton facing the reservoir container forms the first pressure-exerting region and a raised region of the inner side of the pushbutton forms the second pressure-exerting region.

9. The dispenser system of claim 7, wherein the second pressure-exerting region has an annular, oval or rectangular shape and circumscribes the first pressure-exerting region.

10. The dispenser system of claim 2 wherein a pushbutton is adapted to receive a first pressure piece or a second pressure piece which is thicker compared to the first pressure piece, wherein an end of the first pressure piece facing away from the pushbutton defines the first pressure-exerting region and an end of the second pressure piece facing away from the pushbutton defines the second pressure-exerting region.

11. The dispenser system of claim 2 wherein a pushbutton receives a pressure piece configured to rotate or slide, wherein the pressure piece defines two pressure faces offset from one another in the actuation direction (R), the pressure faces define the first pressure-exerting region and the second pressure-exerting region and are displaceable by sliding the pressure piece so that, as a result of the swiveling motion of the pushbutton, the first pressure exerting region or the second pressure exerting region respectively abuts against the first pressure-receiving region of the first reservoir cartridge or the second pressure-receiving region of the second reservoir cartridge at an end section of the motion of the pressure piece and traverses the first or second pressure receiving region in the actuation direction (R) upon further actuation of the pushbutton.

12. The system of claim 2 wherein the actuation device is rotatable with respect to the body.

13. The system of claim 2 wherein the first and second media consists of pasty, liquid, sprayable or foamed media.

* * * * *